US011745533B2

(12) United States Patent
Tempest

(10) Patent No.: US 11,745,533 B2
(45) Date of Patent: Sep. 5, 2023

(54) SECURITY SHEET AND A SECURITY BOOKLET

(71) Applicant: HID CID Limited, Basingstoke (GB)

(72) Inventor: David Ian Tempest, Hampshire (GB)

(73) Assignee: HID CID LIMITED, Basingstoke (GB)

( * ) Notice: Subject to any disclaimer, the term of this patent is extended or adjusted under 35 U.S.C. 154(b) by 0 days.

(21) Appl. No.: 17/266,816

(22) PCT Filed: Jul. 29, 2019

(86) PCT No.: PCT/GB2019/052111
§ 371 (c)(1),
(2) Date: Feb. 8, 2021

(87) PCT Pub. No.: WO2020/039162
PCT Pub. Date: Feb. 27, 2020

(65) Prior Publication Data

US 2021/0339556 A1 Nov. 4, 2021

(30) Foreign Application Priority Data

Aug. 24, 2018 (GB) ..... 1813874

(51) Int. Cl.
*B42D 25/346* (2014.01)
*B42D 25/24* (2014.01)
(Continued)

(52) U.S. Cl.
CPC ..... *B42D 25/346* (2014.10); *B42D 25/24* (2014.10); *B42D 25/351* (2014.10);
(Continued)

(58) Field of Classification Search
CPC .... B42D 25/346; B42D 25/24; B42D 25/351; B42D 25/435; B42D 25/45; B42D 25/23; B42D 25/29
(Continued)

(56) References Cited

U.S. PATENT DOCUMENTS

2001/0045455 A1 11/2001 Kreuter et al.

FOREIGN PATENT DOCUMENTS

CN 1131930 A 9/1996
CN 1196135 A 10/1998
(Continued)

OTHER PUBLICATIONS

"International Application Serial No. PCT/GB2019/052111, International Preliminary Report on Patentability dated Mar. 11, 2021", 6 pgs.

(Continued)

*Primary Examiner* — Justin V Lewis
(74) *Attorney, Agent, or Firm* — Schwegman Lundberg & Woessner, P.A.

(57) ABSTRACT

The present invention is directed towards a security sheet and a security booklet comprising a security sheet. The present invention is further directed towards manufacturing a security sheet and security booklet and a method of authenticating a security booklet. The security sheet comprises a plastic substrate having first and second outer surfaces, at least one opaque region at least partially surrounding at least one window and perforations extending between the first and second outer surfaces. The perforations form a first data element located partially in the at least one window and partially in the at least one opaque region.

17 Claims, 5 Drawing Sheets

(51) Int. Cl.

| | |
|---|---|
| ***B42D 25/351*** | (2014.01) |
| ***B42D 25/435*** | (2014.01) |
| ***B42D 25/45*** | (2014.01) |
| ***B42D 25/23*** | (2014.01) |
| ***B42D 25/29*** | (2014.01) |

(52) U.S. Cl.
CPC ..... *B42D 25/435* (2014.10); *B42D 25/45* (2014.10); *B42D 25/23* (2014.10); *B42D 25/29* (2014.10)

(58) Field of Classification Search
USPC .... 283/67, 70, 72, 74, 94, 98, 107, 111, 901
See application file for complete search history.

(56) References Cited

FOREIGN PATENT DOCUMENTS

| | | | | |
|---|---|---|---|---|
| CN | 1236345 | A | | 11/1999 | |
| CN | 1589457 | A | | 3/2005 | |
| CN | 101171145 | A | | 4/2008 | |
| CN | 101228036 | A | | 7/2008 | |
| CN | 101754862 | A | | 6/2010 | |
| CN | 101849067 | A | | 9/2010 | |
| CN | 102656021 | A | | 9/2012 | |
| CN | 103338942 | A | | 10/2013 | |
| CN | 103429437 | A | | 12/2013 | |
| CN | 104602921 | A | | 5/2015 | |
| CN | 105431301 | A | | 3/2016 | |
| CN | 106457870 | A | | 2/2017 | |
| CN | 107635789 | A | | 1/2018 | |
| CN | 108698430 | A | | 10/2018 | |
| CN | 112770914 | | | 5/2021 | |
| DE | 102006046628 | A1 | | 4/2008 | |
| EP | 1516749 | | | 3/2005 | |
| EP | 1516749 | A2 | | 3/2005 | |
| EP | 3243669 | A2 | | 11/2017 | |
| GB | 2531581 | A | * | 4/2016 | ..... B42D 25/24 |
| GB | 2543053 | A | | 4/2017 | |
| GB | 2548643 | A | | 9/2017 | |
| GB | 2553391 | A | * | 3/2018 | ..... B42D 25/346 |
| GB | 2553391 | A | | 3/2018 | |
| JP | 2000094868 | A | | 4/2000 | |
| JP | 2003011560 | A | | 1/2003 | |
| JP | 2006205674 | A | | 8/2006 | |
| WO | WO-2011015798 | A1 | | 2/2011 | |
| WO | WO-2011098803 | A1 | | 8/2011 | |
| WO | WO-201 2046213 | A1 | | 4/2012 | |
| WO | WO-2016177447 | A1 | | 11/2016 | |
| WO | 2017060683 | | | 4/2017 | |
| WO | 2017060688 | | | 4/2017 | |
| WO | 2017163062 | | | 9/2017 | |
| WO | WO-2018037236 | A1 | | 3/2018 | |

OTHER PUBLICATIONS

"Doc 9303: Machine Readable Travel Documents, 7th Ed.", International Civil Aviation Organization (ICAO), [Online] Retrieved from the Internet: <URL: https://www.icao.int/publications/pages/publication.aspx?docnum=9303>, (2015), 660 pgs.

"International Application Serial No. PCT/GB2019/052111, International Search Report dated Sep. 6, 2019", 3 pgs.

"International Application Serial No. PCT/GB2019/052111, Written Opinion dated Sep. 6, 2019", 4 pgs.

"United Kingdom Application Serial No. 1813874.3, Search and Examination Report under Sections 17 & 18(3) dated Feb. 19, 2019", 7 pgs.

"Chinese Application Serial No. 201980055436.1, Office Action dated Dec. 24, 2021", w/English Translation, 16 pgs.

"Chinese Application Serial No. 201980055436.1,Response filed Apr. 11, 2022 to Office Action dated Dec. 24, 2021", w/ English Claims, 8 pgs.

* cited by examiner

SECURITY SHEET AND A SECURITY BOOKLET

CROSS-REFERENCE TO RELATED APPLICATIONS

The present application is a national stage application under 35 U.S.C. § 371 of PCT Application No. PCT/GB2019/052111, filed Jul. 29, 2019, which claims the benefit of GB Application No. 1813874.3, filed Aug. 24, 2018, each of which is hereby incorporated herein by reference in its entirety.

TECHNICAL FIELD

The present invention is directed towards a security sheet and a security booklet comprising a security sheet. The present invention is further directed towards manufacturing a security sheet and security booklet and a method of authenticating a security booklet.

BACKGROUND

Security booklets, such as passports, passbooks, identification documents, certificates, licences, cheque books and the like, commonly comprise one or more security sheets on which information is provided. In the case of a passport, the security booklet typically comprises a cover, a plurality of internal visa pages and at least one security sheet displaying the personal data of the holder. Typically the visa pages are made from paper and are sewn together along a stitch line coincident with the fold line of the document. The security sheet typically comprises non-variable data and personal data. The non-variable data is the same across a series of security booklets and comprises, for example, the name of the issuing country, the document name (e.g. "passport") and field identifiers (e.g. "name" or "date of birth"). The personal data, also referred to as variable data, is unique to each security booklet and relates to the holder of the booklet. Examples of personal data include a serial number, name, date of birth, nationality, portrait and the like.

A known method of applying personal data to the booklet comprises laser perforating the security sheet. US-A-2001045455 discloses a passport production system and method including a laser personalisation module for perforating the pages of a passport. Often, in the case of a passport, a serial number is laser perforated through the security sheet, visa pages and rear cover. The perforations in each page are therefore aligned with one another and any misalignment can be identified by a document inspector. As a result, it is difficult for a counterfeiter to replace a genuine page with a counterfeit or adapted page as they will need to ensure that the perforations are aligned with those of the other pages. However, further advances are needed to yet further increase the difficulty of counterfeiters in adapting security sheets with perforations.

SUMMARY

Objects of the present invention therefore include providing improved security sheets and booklets that are harder for a counterfeiter to adapt. Further objects include improving the ease of detection of adapted security sheets and booklets.

The present invention therefore provides a security sheet comprising a plastic substrate, the plastic substrate comprising first and second outer surfaces, at least one opaque region at least partially surrounding at least one window and perforations extending between the first and second outer surfaces, wherein the perforations form a first data element located partially in the at least one window and partially in the at least one opaque region.

The present invention further provides a method of forming a security sheet comprising: forming a plastic substrate comprising first and second outer surfaces and at least one opaque region at least partially surrounding at least one window; forming perforations extending between the first and second outer surfaces and through the at least one window and at least one opaque region, wherein the perforations form a first data element located partially in the at least one window and partially in the at least one opaque region.

Due to at least one perforation of the first data element being located in the at least one window the security sheet is harder to fraudulently adapt. In particular, if someone attempts to replace or adapt the at least one window then they will need to ensure that the replacement window(s) comprises the at least one perforation located correctly relative to the at least one perforation in the opaque region such that the first data element is still formed. Furthermore, the at least one perforation in the replacement window(s) would need to be perfectly aligned with the corresponding perforations of the at least one leaf and/or cover. Any misalignment would be easily visible through the replacement window(s). Thus the threat of adaption is reduced, particularly in embodiments in which the at least one window is formed by at least one insert laminated with a plurality of layers to form the plastic substrate.

BRIEF DESCRIPTION OF THE DRAWINGS

By way of example only, embodiments of a security sheet, a security booklet and methods in accordance with the present invention are now described with reference to, and as shown in, the accompanying drawings, in which.

DETAILED DESCRIPTION

Figure 1:
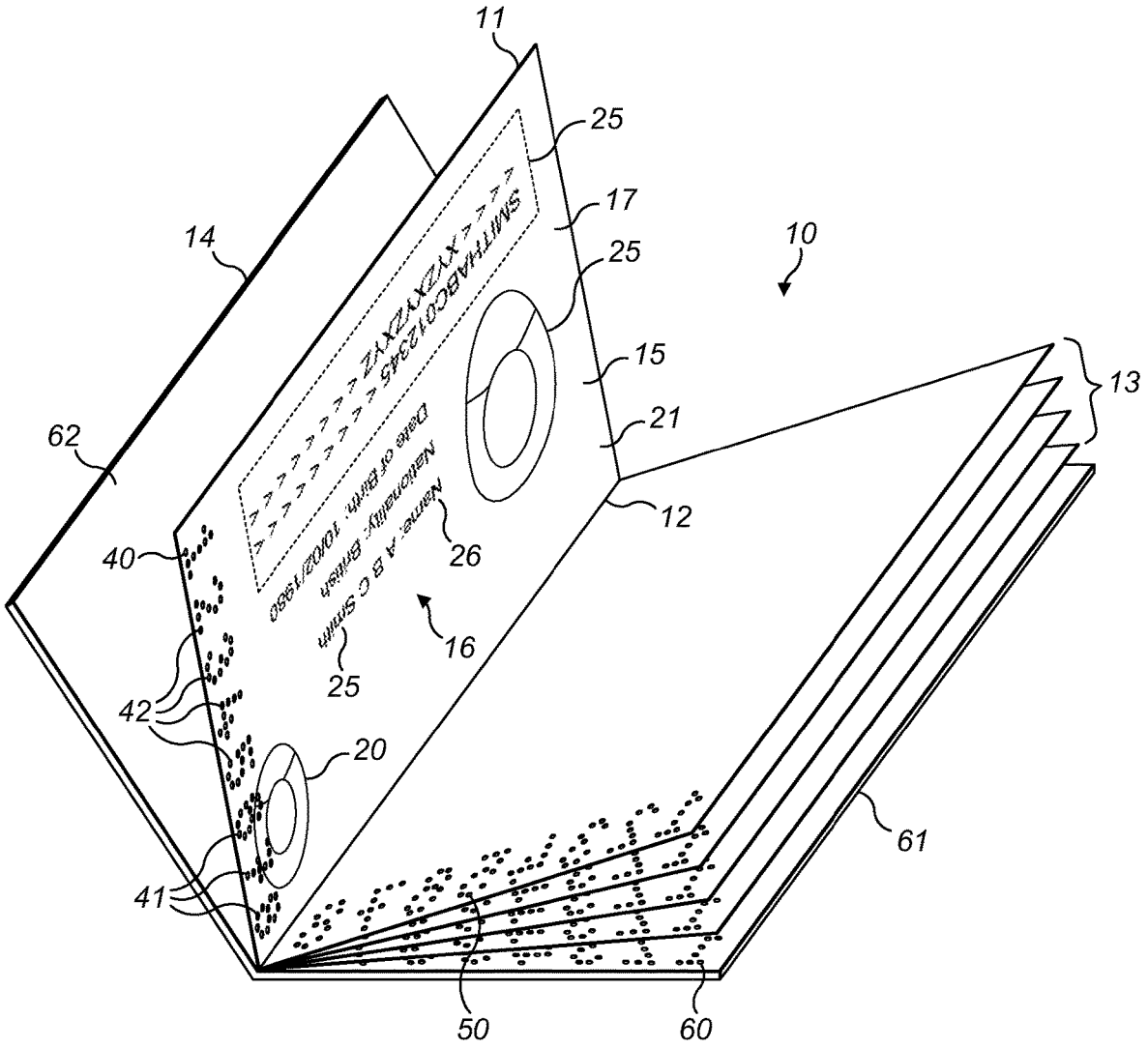
FIG. 1 is a perspective view of an embodiment of a security booklet, particularly a passport, according to the present invention in an open configuration between a security sheet and an adjacent leaf.
Figure 2:
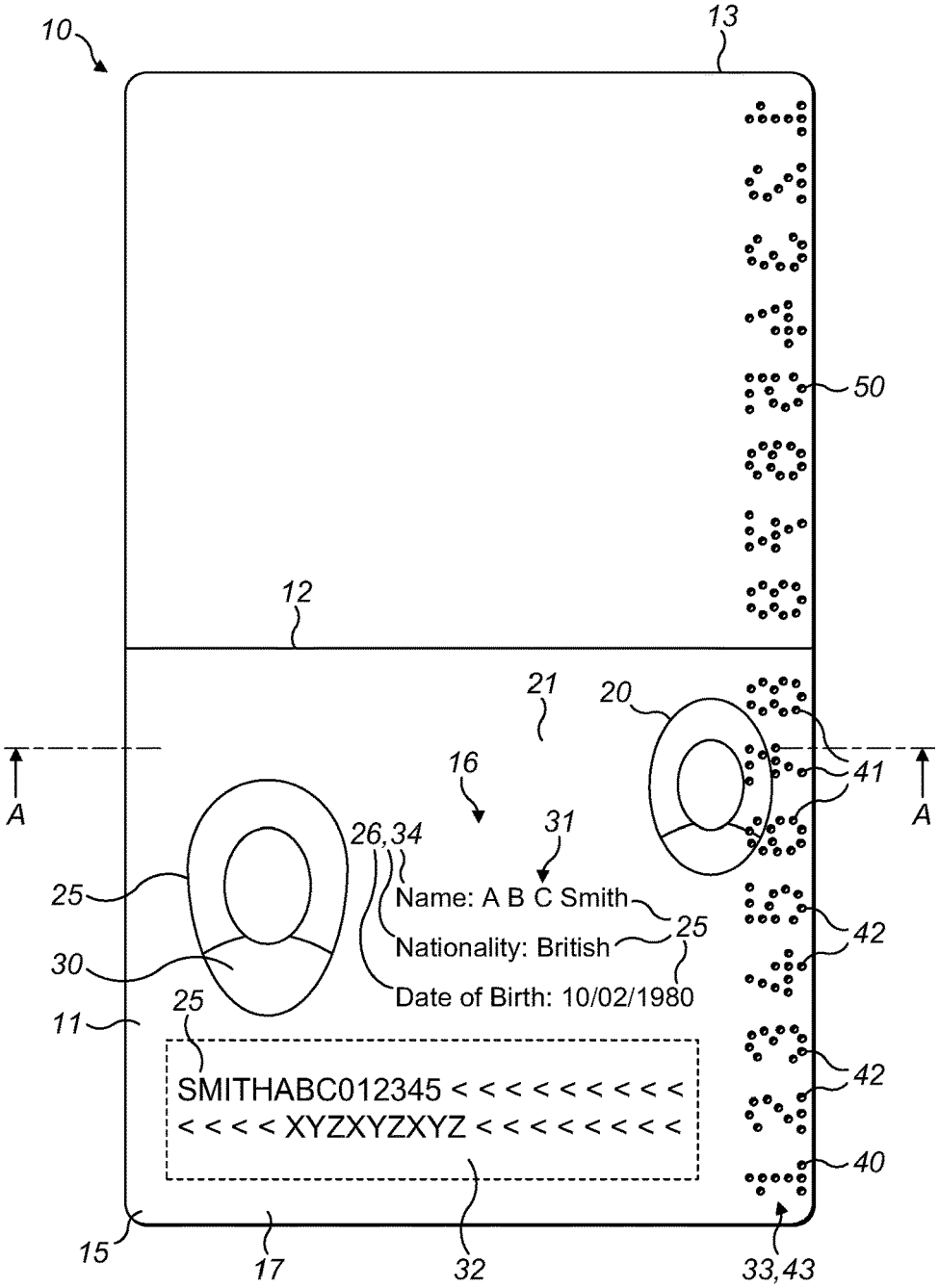
FIG. 2 is a schematic plan view of the security booklet of FIG. 1 in an open configuration between the security sheet and the adjacent leaf.

FIGS. 1 to 6 illustrate a security booklet 10 comprising a security sheet 11 in accordance with the present invention. The security booklet 10 may be of any suitable type, but preferably comprises a passport as illustrated, a passbook, an identification document, a certificate, a licence, a cheque book or the like. The security booklet 10 comprises the security sheet 11, in this case a data page, foldable about and preferably attached along a fold line 12 to at least one leaf 13, which preferably comprise a fibrous substrate, comprising for example paper and/or cotton, and may form visa pages. The security booklet 10 also comprises a cover 14, which may also be foldable about and attached to the fold line 12 and/or may be adhered to an outer leaf (not shown) located on the outside of the leaves 13 and security sheet 11. The attachment is preferably by means of stitching through the security sheet 11, leaves 13 and/or cover 14 at the fold line 12, although other attachment means such as adhesion may be used.

The security sheet 11 comprises a plastic substrate 15 and displays data 16. The plastic substrate 15 extends across a thickness between substantially planar first and second outer surfaces 17, 18. Preferably the security sheet 11 and plastic substrate 15 are substantially rigid or at least semi-rigid. The plastic substrate 15 may comprise at least one of a thermoplastic polymer, polycarbonate, polybutylene terephthalate, polyester, polyethylene, polypropylene, polyvinyl chloride, a co-polymer comprised of any of the previous thermoplastic polymers and the like. The thickness of the plastic substrate 15 is preferably at least approximately 150 μm and may be between approximately 300 μm and approximately 1000 μm thick.

Figure 3:
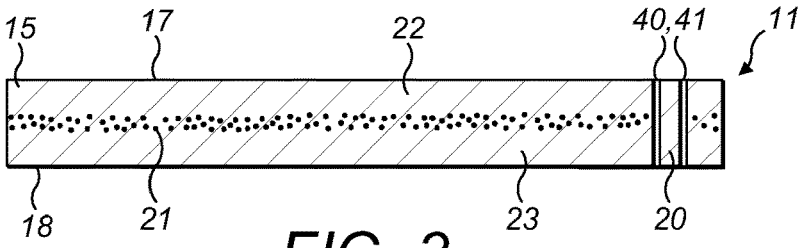
FIG. 3 is a cross-sectional side elevation of the security sheet of FIG. 2 through elevation A-A.

The plastic substrate 15 comprises at least one window 20 and at least one substantially opaque region 21 that defines the at least one window 20 by at least partially surrounding the at least one window 20. As illustrated in FIG. 3 the at least one opaque region 21 is located within the thickness of the plastic substrate 15 and may be separated from the first and second outer surfaces 17, 18 by first and second substantially transparent regions 22, 23. The at least one opaque region 21 substantially prevents the transmission of light through it. The plastic substrate 15 may comprise a plurality of opaque regions 21, such as if opaque regions 21 are entirely separated by one or more of the at least one window 20. The at least one window 20 is a substantially transparent region extending between the first and second outer surfaces 17, 18 and may be clear or coloured. As a result, when the security sheet 11 overlies the cover 14 or leaf 13 adjacent to the security sheet 11 an inspector can view the cover 14 or leaf 13 respectively through the at least one window 20. In the illustrated embodiment the security sheet 11 comprises a single oval window 20 entirely surrounded by the opaque region 21. However, in other embodiments the security sheet 11 comprises a plurality of windows 20, the at least one window 20 has another shape, such as a pattern, indicia, symbol, logo or the like, and/or the at least one window 20 may be at an edge of the plastic substrate 15 such that it is bounded partially by the opaque region 21 and partially by the edge.

The plastic substrate 15 is generally manufactured by forming at least one insert, forming a plurality of plastic layers, including the at least one insert therein, and laminating the plurality of plastic layers together in a laminator to form the plastic substrate 15. The plurality of plastic layers includes opaque inner core layers to form the opaque region 21 and outer transparent layers to form the first and second transparent regions 22, 23. Each at least one insert is substantially transparent and is positioned in an aperture in the plurality of plastic layers, thereby forming the at least one window 20 after lamination. Suitable methods of manufacture are also disclosed in WO-A-2017/060683 and WO-A-2017/060688.

The data 16 comprises at least one data entry 25, 26 and each at least one data entry 25 comprises at least one data element. Each at least one data entry 25, 26 forms a piece of recognisable or intelligible information, such as a word or a multi-digit number, whilst each at least one data element is a component part of the at least one data entry 25, 26. In particular, a data entry 25, 26 may only be complete and/or intelligible if all of its data elements are present—i.e. a set of data elements together form and/or are required to be present to form a complete data entry 25, 26. Each at least one data entry 25, 26 may be a personal or variable data entry 25, such as holder portrait(s) 30, text 31 (e.g. at least one of a holder name, holder date of birth, holder nationality, holder address, holder residency, security booklet 10 issue date and/or security booklet 10 expiry date), machine readable zone 32, serial number 33, and fixed or non-variable data entry 26, such as field identifiers 34. The Seventh Edition (2015) of Document 9303 ("Machine Readable Travel Documents") issued by the International Civil Aviation Organization (ICAO) describes such variable and non-variable data entries 25, 26. Each at least one data element comprises, for example, a grapheme, which is the smallest unit of a writing system such as alphanumeric characters, letters, numerical digits, characters or logograms, or a symbol, logo, indicia, portrait or the like. For example, in the case of the text 31, serial number 33 and field identifiers 34 the data elements comprise graphemes in the form of letters or numbers. At least part of the data 16 may be applied by laser marking and/or printing ink.

The security sheet 11 further comprises perforations 40 extending between the first and second outer surfaces 17, 18 of the plastic substrate 15 and forming at least part of at least one data entry 25, 26. In particular, the perforations 40 form a first data element 41 located partially in the at least one window 20 and partially in the at least one opaque region 21. Therefore the first data element 41 is partially formed by or comprises at least one perforation 40 in and extending through the at least one window 20 and partially formed by or comprises at least one perforation 40 in and extending through the at least one opaque region 21. The illustrated security sheet 11 comprises a plurality of first data elements 41, each of the first data elements 41 being located partially in the at least one window 20 by being formed from at least one perforation 40 therein and partially in the at least one opaque region 21 by being formed from at least one perforation 40 therein.

The illustrated security sheet 11 further comprises perforations 40 forming at least one second data element 42 located entirely in the at least one opaque region 21. The first and second data elements 41, 42, in this case numerical digits, form a complete data entry 43, in this case the serial number 33, which may be unique to the security booklet 10 amongst a series of such security booklets 10. However, alternatively, just one first or second data element 41, 42 may form a complete data entry 43 or a plurality of first data elements 41 may form a complete data entry 43. The complete data entry 43 is preferably a variable data entry 25, although may instead be a non-variable data entry 26. The first and second data elements 41, 42 are formed by the perforations 40 being located relative to one another such that they outline or define the shape of the first and second data elements 41, 42. The perforations 40 of each first and second data element 41, 42 are separate from one another, such that the lines of the first and second data elements 41, 42 are broken.

Figure 5:
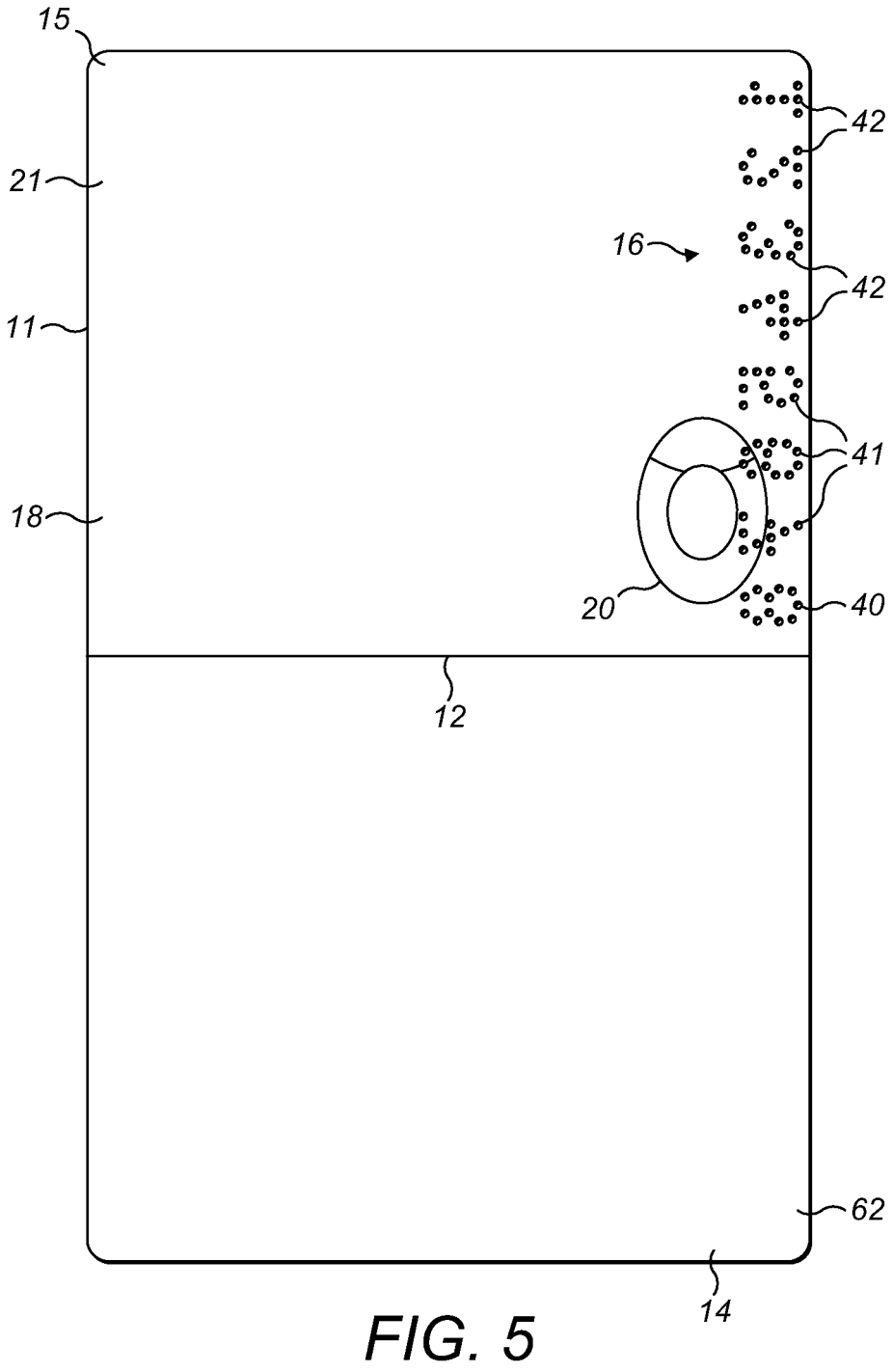
FIG. 5 is a schematic plan view of the security booklet of FIG. 1 in an open configuration between the security sheet and a cover.
Figure 6:
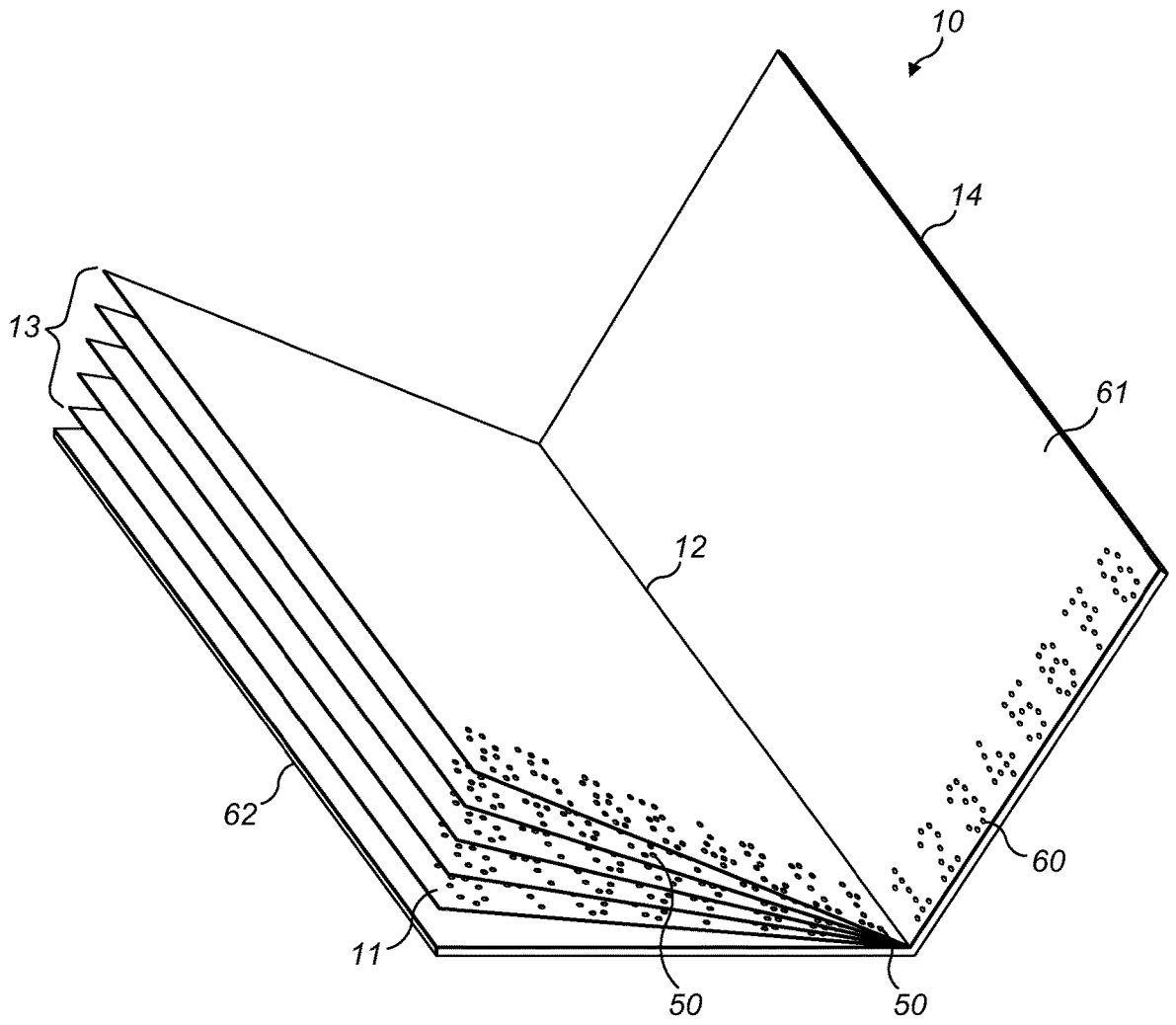
FIG. 6 is a perspective view of the security booklet of FIG. 1 in an open configuration between the cover and an end leaf.

In the illustrated embodiment, the data entry 43 formed by the perforations 40 and first and/or second data elements 41, 42 in the security sheet 11 is also present in the at least one leaf 13 and/or cover 14. At least the leaf 13 adjacent to the security sheet 11, and preferably all of the leaves 13 of the security booklet 10 as illustrated, comprise perforations 50 aligned or registered with the perforations 40 of the security sheet 11. As best illustrated in FIGS. 5 and 6, the cover 14 may also comprise perforations 60 aligned or registered with the perforations 40, 50 of the at least one leaf 13 and/or security sheet 11. The cover 14 may only comprise perforations 60 in a first side 61 thereof and not in a second side 62 thereof, the second side 62 being on the opposing side of the fold line 12 to the first side 61. In particular, the perforations 40, 50, 60 of the security sheet 11, at least one leaf 13 and/or cover 14 overlie one another and have aligned perimeters when the security sheet 11, at least one leaf 13 and/or cover 14 are folded about the fold line 12 such that they overlie one another. Each group of aligned perforations 40, 50, 60 in the security sheet 11, at least one leaf 13 and/or cover 14 have the same shape and the same location relative to an edge of the security booklet 10.

Figure 4:
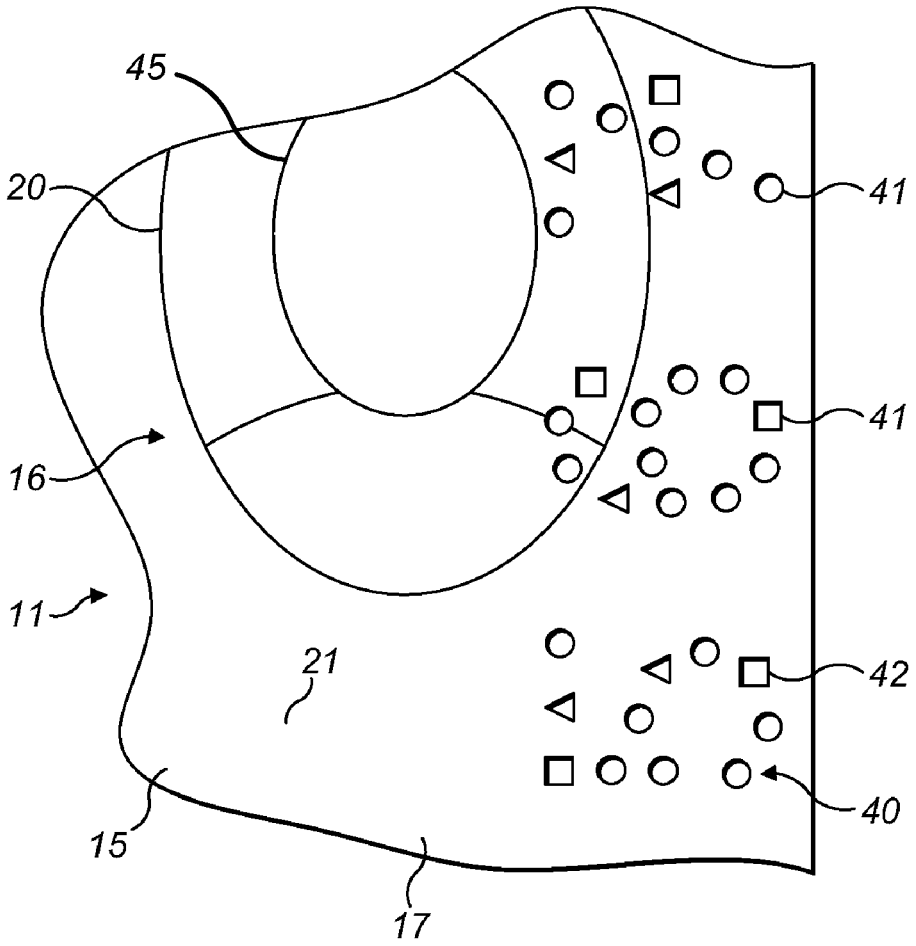
FIG. 4 is a magnified view of a portion of the security sheet of FIGS. 2 and 3.

As illustrated in FIG. 4, the perimeter of each perforation 40, 50, 60 may define an identifiable shape such as a circle, triangle or square. In other embodiments the perimeter of each perforation 40, 50, 60 defines a grapheme (e.g. an alphanumeric character), symbol, logo, indicia or the like. Furthermore, although not shown, the diameter of the perforations 40, 50, 60 may vary between the security sheet 11, at least one leaf 13 and/or cover 14, such as by being larger in the security sheet 11 than in the at least one leaf 13 and/or cover 14.

The perforations 40, 50, 60 are preferably laser perforations 40, 50, 60 formed by laser perforating the security sheet 11, at least one leaf 13 and/or cover 14. In order to ensure a very accurate alignment of the perforations 40, 50, 60 the laser perforating is performed after the security sheet 11 has been formed and attached with the at least one leaf 13 and/or cover 14 to form the security booklet 10. In particular, the security booklet 10 may be opened between the second side 62 of the cover 14 and the security sheet 11 as in FIG. 5. A laser is subsequently directed onto the second outer surface 18 of the security sheet 11 and perforates the security sheet 11, at least one leaf 13 and/or cover 14 to form aligned perforations 40, 50, 60 through them. The laser or other lasers form the rest of the perforations 40, 50, 60 of the first and second data elements 41, 42 in a similar manner. However, any other suitable method of forming the perforations 40, 50, 60 may be used, such as punching.

The security sheet 11 may also comprise at least one third data element 45 entirely located in the at least one window 20, partially overlapping the at least one window 20 and at least one opaque region 21 or located entirely in the at least one opaque region 21. The at least one third data element 45 preferably comprises variable data entries 25, in this case a holder portrait 30 located in the at least one window 20. The at least one third data element 45 is preferably applied in a different manner to the perforations 40. In particular, the at least one third data element 45 may be applied to the security sheet 11 printing ink or laser marking, and is preferably applied after the formation of the plastic substrate 15 by lamination. Alternatively, although not illustrated, the at least one third data element 45 may be formed from perforations 40 and is entirely located within the at least one window 20. In any of the aforementioned embodiments the at least one third data element 45 may form the complete data entry 43 with the at least one first and/or second data elements 41, 42.

Thus the security booklet 10 can only be authenticated if the at least on window 20 is correctly present with the correct perforations 40 partially forming the first data element 41. The security booklet 10 can be authenticated by ensuring that the first and/or second data elements 41, 42 form the complete data entry 43. An incomplete or incorrect first data element 41 due to replacement of the at least one window 20 can thus be identified. The security booklet 10 can also be authenticated by ensuring that the perforations 40, 50, 60 of the security sheet 11, at least one leaf 13 and/or cover 14 are aligned by viewing the security booklet 10 through the perforations 40, 50, 60. Any misalignment of the perforations 40 in the at least one window 20 can also be identified by viewing them adjacent to the perforations 50, 60 of the adjacent leaf 13 and/or cover 14.

Hence the threat of fraudulent adaption by removal or adjustment of the at least one window 20 is reduced by virtue of the first data element 41 being partially located in the at least one window 20. The incorporation of the at least one third data element 45 as a variable data entry 25 in the same at least one window 20 as the first data element 41 would also mean that a person attempting to adapt the security booklet 10, such as by changing the identity of the holder, would necessarily have to remove or adapt the at least one window 20. Furthermore, by the first and/or second data elements 41, 42 forming a complete data entry 43 the adapter would need to replace the opaque region 21 and at least one window 20 if they wanted to change the data entry 43.

Various alternatives to the embodiments discussed above fall within the scope of the present invention. Rather than forming part of a security booklet 10 the security sheet 11 may be an independent security document, such as in the form of a card. At least one leaf 13, particularly the at least one leaf 13 adjacent to the security sheet 11, may comprise a polymer substrate as disclosed in WO-A-2017/163062.

Rather than being in the form of a substantially rigid plastic substrate 15 the security sheet 11 may instead comprise a substantially flexible plastic substrate 15 and at least one opacifying layer located on at least one surface of the flexible plastic substrate 15. Such flexible plastic substrates 15 are commonly used to form "polymer" banknotes, can contain a variety of security features and may comprise, for example, bi-axially oriented PP (BOPP). The at least one opacifying layer forms the at least one opaque region 21 and is omitted in localised regions on opposing sides of the flexible plastic substrate 15, which is substantially transparent, in order to form the at least one window 20. WO-A-2017/163062 discloses suitable structures of such flexible plastic substrates 15.

The invention claimed is:

1. A security sheet comprising a plastic substrate, the plastic substrate comprising:

first and second outer surfaces of the security sheet;

at least one opaque region at least partially surrounding at least one substantially transparent, plastic window extending through the plastic substrate between the first and second outer surfaces; and perforations extending through the plastic substrate between the first and second outer surfaces, wherein the perforations form a first data element located partially in the at least one window and partially in the at least one opaque region.

2. A security sheet as claimed in claim 1 wherein the perforations form at least one second data element in the at least one opaque region.

3. A security sheet as claimed in claim 2 wherein the perforations form a third data element entirely located in the at least one window.

4. A security sheet as claimed in claim 1 wherein the perforations form a first plurality of data elements, including the first data element, each of the first plurality of data elements being located partially in the at least one window and partially in the at least one opaque region.

5. A security sheet as claimed in claim 1 wherein the perforations form at least one of:

a first plurality of data elements, including the first data element, located partially in the at least one window and partially in the at least one opaque region; or a second plurality of data elements in the at least one opaque region; and wherein the at least one of the first plurality of data elements or second plurality of data elements together form a complete data entry.

6. A security sheet as claimed in claim 5 wherein the complete data entry comprises variable data.

7. A security sheet as claimed in claim 1 wherein the perforations are laser perforations.

8. A security sheet as claimed in claim 1 wherein the first data element comprises a grapheme, alphanumeric character, letter, numerical digit, character, logogram, symbol, logo, indicia or portrait.

9. A security sheet as claimed in claim 1 wherein the opaque region is located either within a thickness of the plastic substrate and is separated from at least one of the first or second outer surfaces by at least one transparent region or is formed by at least one opacifying layer making up at least a portion of at least one of the first or second outer surfaces.

10. A security sheet comprising a plastic substrate, the plastic substrate comprising first and second outer surfaces, at least one opaque region at least partially surrounding at least one window, perforations extending between the first and second outer surfaces, wherein the perforations form a first data element located partially in the at least one window and partially in the at least one opaque region, and a second data element located entirely in the at least one window or partially overlapping the at least one window and at least one opaque region, the second data element comprising variable data and applied to the security sheet in a manner different from the perforations.

11. A security booklet comprising:

a security sheet comprising a plastic substrate, the plastic substrate comprising first and second outer surfaces, at least one opaque region at least partially surrounding at least one window, and perforations extending between the first and second outer surfaces, wherein the perforations form a first data element located partially in the at least one window and partially in the at least one opaque region; and at least one leaf comprising perforations aligned with the perforations of the security sheet such that the perforations of the at least one leaf also form the first data element.

12. A security booklet as claimed in claim 11 further comprising a cover around the security sheet and at least one leaf, wherein the cover comprises perforations aligned with the perforations of the security sheet and the at least one leaf such that the perforations of the cover also form the first data element.

13. A security booklet as claimed in claim 12 wherein the aligned perforations of the security sheet, at least one leaf and cover each form identical complete data entries.

14. A method of forming a security sheet comprising:

forming a plastic substrate comprising first and second outer surfaces of the security sheet and at least one opaque region at least partially surrounding at least one substantially transparent, plastic window extending through the plastic substrate between the first and second outer surfaces; and forming perforations extending between the first and second outer surfaces and through the at least one window and at least one opaque region, wherein the perforations form a first data element located partially in the at least one window and partially in the at least one opaque region.

15. A method as claimed in claim 14 wherein the perforations are formed by laser perforation.

16. A method as claimed in claim 14 wherein forming the plastic substrate comprises forming a plurality of plastic layers, inserting at least one insert into at least one aperture in the plurality of plastic layers and laminating the plurality of plastic layers and insert together.

17. A method of forming a security booklet comprising the method of claim 14, comprising attaching the plastic substrate about a fold line to at least one of a leaf or cover, and forming perforations through the plastic substrate and the at least one of the leaf or cover simultaneously.

* * * * *